US011285741B2

(12) United States Patent
Igarashi

(10) Patent No.: US 11,285,741 B2
(45) Date of Patent: Mar. 29, 2022

(54) PRINTING APPARATUS HAVING CUTTING POSITION DETERMINATION UNIT FOR AUTOMATICALLY DETERMINING CUTTING POSITION ON PRINT MEDIUM

(71) Applicant: MIMAKI ENGINEERING CO., LTD., Nagano (JP)

(72) Inventor: Osamu Igarashi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/861,242

(22) Filed: Apr. 29, 2020

(65) Prior Publication Data

US 2020/0361226 A1 Nov. 19, 2020

(30) Foreign Application Priority Data

May 17, 2019 (JP) ..... JP2019-093985

(51) Int. Cl.

| | |
|---|---|
| ***B41J 11/66*** | (2006.01) |
| ***B41J 11/00*** | (2006.01) |
| ***B41J 15/16*** | (2006.01) |
| ***B41J 15/08*** | (2006.01) |
| ***B41J 11/70*** | (2006.01) |

(52) U.S. Cl.

CPC ..... *B41J 11/663* (2013.01); *B41J 11/0095* (2013.01); *B41J 11/70* (2013.01); *B41J 15/08* (2013.01); *B41J 15/165* (2013.01); *B41J 11/66* (2013.01); *B41J 11/666* (2013.01)

(58) Field of Classification Search

CPC ..... B41J 11/663; B41J 11/70; B41J 15/165; B41J 11/0095; B41J 15/08; B41J 11/66; B41J 11/666; B41J 15/16

See application file for complete search history.

(56) References Cited

U.S. PATENT DOCUMENTS

| | | | | |
|---|---|---|---|---|
| 5,970,217 | A * | 10/1999 | Nakamura | B41J 2/16579 347/44 |
| 2011/0211899 | A1* | 9/2011 | Teshigawara | B41J 11/663 400/621 |
| 2012/0188322 | A1* | 7/2012 | Matsunaga | B41J 15/16 347/104 |
| 2018/0264859 | A1* | 9/2018 | Kawamata | B26D 3/085 |
| 2019/0016161 | A1* | 1/2019 | Kawai | B41J 13/0009 |

FOREIGN PATENT DOCUMENTS

| | | |
|---|---|---|
| JP | 2007217149 | 8/2007 |

* cited by examiner

*Primary Examiner* — Henok D Legesse
(74) *Attorney, Agent, or Firm* — JCIPRNET

(57) ABSTRACT

A printing apparatus includes a printing unit that performs printing on a print medium with a sheet shape, a medium feeding unit and a medium winding unit that conveys the print medium in a predetermined conveyance direction, a controller that controls the printing unit, the medium feeding unit, and the medium winding unit, and a shaft that winds the printed print medium. The controller includes a cutting position determination unit that determines a cutting position to cut and separate the print medium in the width direction upstream by a predetermined length from the end of the image of the first print surface in the conveyance direction, and the cutting position determination unit determines the cutting position so as to cut upstream from the end with an increase in the circumferential length of the print medium wound around the shaft.

6 Claims, 5 Drawing Sheets

PRINTING APPARATUS HAVING CUTTING POSITION DETERMINATION UNIT FOR AUTOMATICALLY DETERMINING CUTTING POSITION ON PRINT MEDIUM

CROSS REFERENCE TO RELATED APPLICATIONS

This application claims the priority benefit of Japanese Patent Application No. 2019-093985, filed on May 17, 2019. The entirety of the above-mentioned patent application is hereby incorporated by reference herein and made a part of this specification.

TECHNICAL FIELD

The present disclosure relates to a printing apparatus.

DESCRIPTION OF THE BACKGROUND ART

It is known to add information such as customer names, delivery dates, and serial numbers to margins ("headers" and "footers") of print media in order to check management and contents of the printed matter being stored.

The printed matter printed on the sheet-like medium is stored in a state of being wound up in a roll shape. Japanese Unexamined Patent Publication No. 2007-217149 discloses that, for a sheet-like print medium on which "repeated printing" has been performed, the end of the printed matter is folded back to expose the print surface located at the very end on the front surface. It is disclosed that the management and the contents of the printed matter can be checked even during storage by the print surface exposed on the front surface.

If stored in a state in which the print surface is exposed as in the disclosure described in Japanese Unexamined Patent Publication No. 2007-217149, the print surface deteriorates. Furthermore, when winding and storing a printed matter having one large print surface, even if the end of the printed matter is folded, only a part of the printed matter is exposed on the front surface, which is not suitable for checking the management and the contents of the printed matter. In order to check the management and the contents of the printed matter, it is necessary to unwind the rolled state, which is troublesome.

Therefore, there is a need to be able to store the printed matter, so that the management and the contents of the printed matter can be checked while appropriately protecting the print surface.

SUMMARY

The present disclosure relates to a printing apparatus including:

a printing unit, configured to perform printing on a medium with a sheet shape;

a medium conveying unit, configured to convey the medium in a conveyance direction that is predetermined;

a control unit, configured to control the printing unit and the medium conveying unit; and a winding roller, configured to wind the medium that is printed, wherein the control unit includes a cutting position determination unit configured to determine a cutting position to cut and separate the medium in a width direction upstream by a predetermined length from an end of a part on which a predetermined printing has been performed in the conveyance direction; and the cutting position determination unit is configured to determine the cutting position, so as to cut upstream from the end with an increase in a circumferential length of the medium wound around the winding roller.

According to the present disclosure, the cutting position can be determined (customized) according to the size of a part on which a predetermined printing has been performed. Thus, the print surface can be covered or the management information can be printed using the region from the end of the part where the predetermined printing has been performed to the cutting position. Therefore, the printed matter can be stored such that the management and the contents of the printed matter can be easily checked while appropriately protecting the print surface.

In the printing apparatus according to one aspect of the present disclosure, the printing unit is configured to print a management information in a region between the end and the cutting position where the predetermined printing is not performed.

According to the present disclosure, the content of a printed matter can be checked from management information and the printed matter can be managed based on the management information without unwinding the state of being wound to a roll shape.

In the printing apparatus according to one aspect of the present disclosure, a region between the end and the cutting position is wound to protect the medium of a part on which the predetermined printing has been performed and is wound to expose the management information that is printed on a front surface.

According to the present disclosure, the printed matter can be stored such that management and contents of the printed matter can be checked while appropriately protecting a print surface.

In the printing apparatus according to one aspect of the present disclosure, the cutting position determination unit is configured to determine the cutting position, so that a length of the medium is at least one round of an outer periphery of the medium wound around the winding roller.

According to the present disclosure, since the region between the end and the cutting position covers the entire outer peripheral surface of the medium of a part on which the predetermined printing has been performed, the print surface can be reliably protected.

In the printing apparatus according to one aspect of the present disclosure, the cutting position determination unit calculates the circumferential length C of the part on which the predetermined printing has been performed based on equations (1), (2) and (3) to calculate the length from the end to the cutting position, where R is the winding diameter of the part on which the predetermined printing has been performed, L10 is the entire length of the part on which the predetermined printing has been performed, r is the innermost bend radius when the part on which the predetermined printing has been performed is wound, T is the thickness of the medium M, and π is the Pi.

$$C=\pi R \tag{1}$$

$$R=2(r+nT) \tag{2}$$

$$L10=2\pi rn+\pi Tn(n+1) \tag{3}$$

According to the present disclosure, the cutting position can be determined only by inputting a predetermined parameter.

In the printing apparatus according to one aspect of the present disclosure, the medium conveying unit is configured by, a medium feeding unit provided upstream of the printing unit in the conveyance direction to feed the medium, and a medium winding unit provided downstream of the printing unit in the conveyance direction to wind the medium;

the medium feeding unit includes a feeding speed detecting unit that detects a feeding speed of the medium;

the medium winding unit includes a winding speed detecting unit that detects a winding speed of the medium;

the cutting position determination unit calculates, based on the detection results of the feeding speed detecting unit and the winding speed detecting unit, the circumferential length of the part performed with the predetermined printing that has been wound into a cylindrical shape to calculate the length between the end and the cutting position; and the control unit controls the printing unit and the medium winding unit based on the calculation result of the cutting position determination unit.

According to the present disclosure, the cutting position can be automatically determined.

In the printing apparatus according to one aspect of the present disclosure, the management information is a thumbnail image to be printed on which the predetermined printing has been performed.

According to the present disclosure, the contents can be more easily grasped than when the management information is character information.

In the printing apparatus according to one aspect of the present disclosure, the thumbnail image is printed on the cutting position side.

According to the present disclosure, the thumbnail image can be reliably exposed on the front surface, and thus the management and the contents of the printed matter are visually recognized easily.

In the printing apparatus according to one aspect of the present disclosure, the printing unit prints a boundary line at the end.

According to the present disclosure, the medium wound with the print surface on the inside becomes a mark in turning back to expose the part on which the management information is printed to the outside.

In the printing apparatus according to one aspect of the present disclosure, a medium processing unit that forms an intermittent cut along the end.

According to the present disclosure, a part on which management information is printed can be easily separated after printing is completed.

A control method of a printing apparatus according to one aspect of the present disclosure including:

a printing device that performs printing on a medium with a sheet shape, a medium conveying device that conveys the medium in a predetermined conveyance direction, and a control device that controls the printing device and the medium conveying device with the controller; where the control device determines a cutting position for cutting upstream by a predetermined length from the end of on which a predetermined printing has been performed with a cutting position determination device, the cutting position determination device determines the cutting position so as to cut more upstream from the end with increase in the length of the medium on which the predetermined printing has been performed, the printing device prints management information between the end and the cutting position, the region between the end and the cutting position is wound so as to protect the medium on which the predetermined printing has been performed and is wound so that the printed management information is exposed on the front surface, and the cutting position determination device calculates the length between the end and the cutting position so as to surround the outer periphery of the part on which the predetermined printing has been performed over the entire periphery in a state in which the medium is wound from the downstream side to the upstream side in the conveyance direction.

According to the present disclosure, at the time of printing, control can be performed such that the part where the management information is printed is exposed on the front surface.

In a control method of a printing apparatus according to one aspect of the present disclosure, the medium conveying device includes a medium feeding device provided upstream of the printing device in the conveyance direction to feed the print medium, and a medium winding device provided downstream of the printing device in the conveyance direction to wind the medium; where the medium feeding device detects a feeding speed of the medium with a feeding speed detecting unit, the medium winding device detects a winding speed of the medium with a winding speed detection unit, the cutting position determination device calculates, based on the detection results of the feeding speed detecting unit and the winding speed detecting unit, the circumferential length of a part on which the predetermined printing has been performed that has been wound into a cylindrical shape to calculate a length between the end and the cutting position, and the control device controls the printing device and the medium winding device based on the calculation result of the cutting position determination device.

According to the present disclosure, the cutting position can be automatically determined.

DETAILED DESCRIPTION OF EMBODIMENTS

Hereinafter, a case where the printing apparatus of the present disclosure is a printer 1 will be described as an example.

The printer 1 according to the present embodiment prints characters, drawings, and the like by ejecting ink onto a print surface of a band-shaped print medium M such as a cloth (fabric cloth) or a resin sheet (e.g., made of vinyl chloride, polyester, etc.).

Figure 1A:
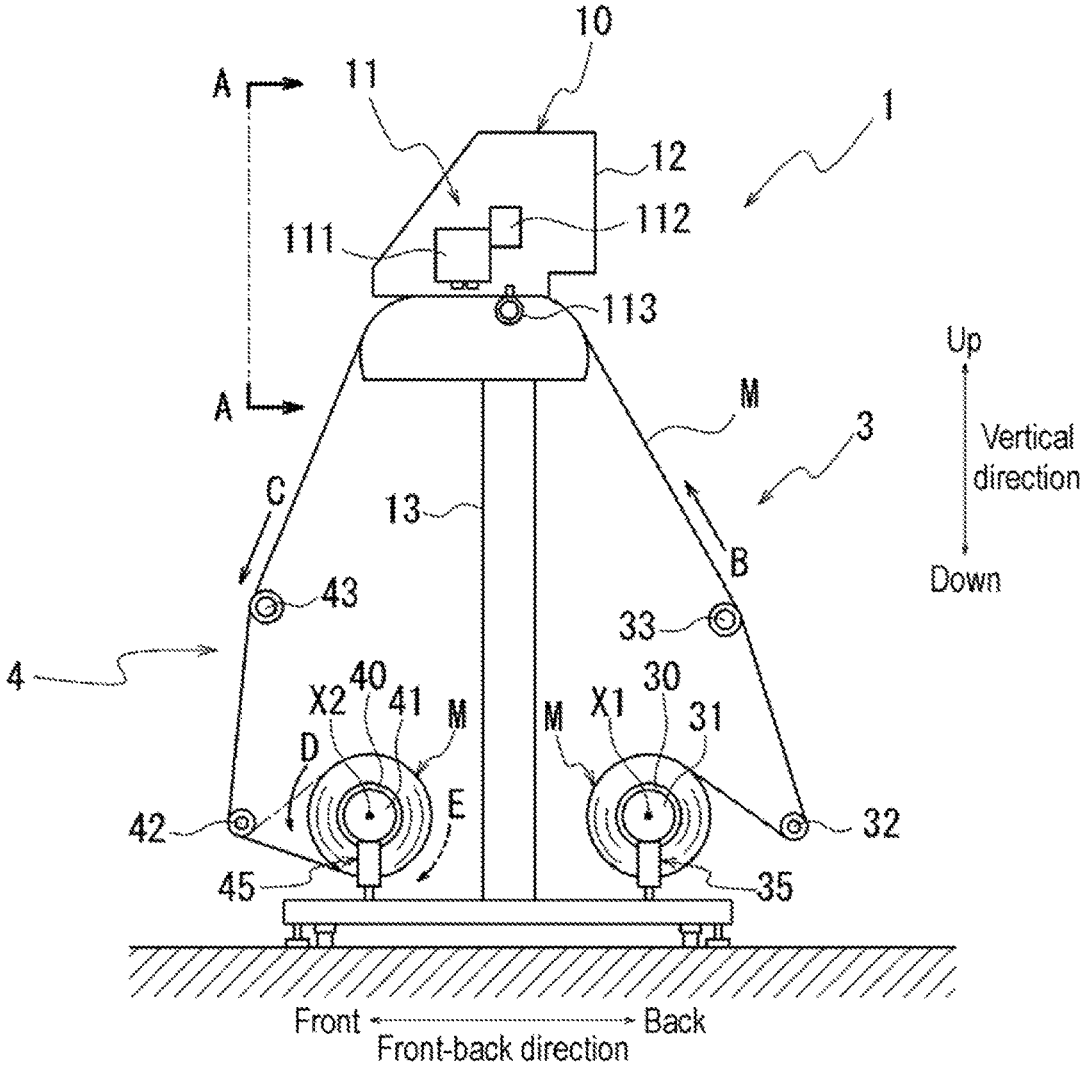
FIGS. 1A and 1B are views describing a printer according to the present embodiment.
Figure 1B:
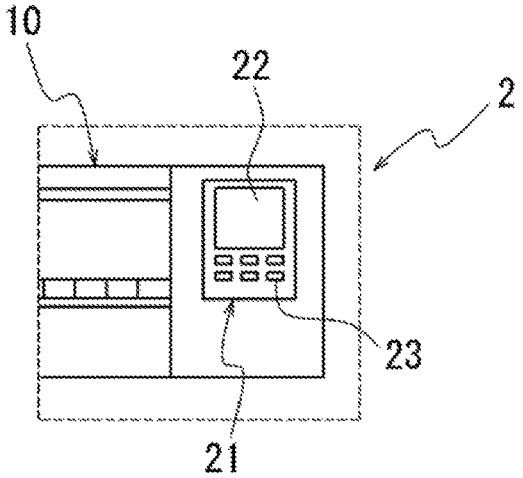

FIGS. 1A and 1B are views describing the printer 1 according to the present embodiment. FIG. 1A is a schematic configuration diagram of the printer 1. FIG. 1B is a view taken along the line AA in FIG. 1A, and is a view describing an operation panel 21 of a controller 2. In FIG. 1A, the support members that support shafts 31, 41, tension applying device 32, 42, and guide device 33, 43 are omitted.

In the drawings, up-down direction will be described as meaning up and down in the vertical direction with respect to the installed printer 1. In the drawings, front-back direction will be described as meaning front and rear when the printer 1 is viewed from the front with respect to the installed printer 1. In the drawings, left-right direction will be described as meaning left and right when the printer 1 is viewed from the front with respect to the installed printer 1.

As shown in FIGS. 1A and 1B, the printer 1 according to the present embodiment includes a body 10, a medium feeding unit 3 for feeding a print medium M to the body 10, a medium winding unit 4 that takes out and winds the print medium M from the body 10, and a controller 2 that controls the body 10, the medium feeding unit 3, and the medium winding unit 4.

The body 10 is configured by a printing unit 11 that performs printing on the print medium M, a housing 12 that houses the printing unit 11, and a supporting unit 13 that extends downward from the housing 12.

The printing unit 11 includes a printer head 111 that ejects ink, a carriage 112 that moves the printer head 111 in the left-right direction, and a feeding mechanism 113 that feeds the print medium M in the front-back direction.

The medium feeding unit 3 is provided on the rear side (rear surface side) with the supporting unit 13 in between in the front-back direction of the printer 1. The medium winding unit 4 is provided on the front side (front side) with the supporting unit 13 in between in the front-back direction of the printer 1.

The band-shaped print medium M is stretched between the medium feeding unit 3 and the medium winding unit 4 across the body 10 in the longitudinal direction in a state of being set in the printer 1. In this state, one end side and the other end side of the print medium M in the longitudinal direction (see FIG. 3A) are wound around the core members 30 and 40 and held in a roll shape by the medium feeding unit 3 and the medium winding unit 4. The core members 30 and 40 have a cylindrical shape. The center axes X1, X2 of the core members 30, 40 are parallel to the left-right direction of the printer 1.

[Medium Feeding Unit 3]

The medium feeding unit 3 holds the unprinted print medium M in a roll shape. The medium feeding unit 3 includes a shaft 31 that passes through the roll-shaped print medium M (core member 30) in the direction of the center axis X1, a tension applying device 32 that applies tension (tensile force) to the print medium M, a guide device 33 that guides the print medium M to the body 10, and a feeding speed detecting unit 35 that detects a rotation speed around the center axis X1 of the roll-shaped print medium M.

The center line of the shaft 31 is provided coaxially with the center axis X1 of the core member 30. Since known units can be used for the tension applying device 32 and the guide device 33, the description will be omitted.

The medium feeding unit 3 sequentially feeds (conveys) the portions located at the outermost periphery to the body 10 while rotating the print medium M about the center axis X1 through the shaft 31. The print medium M is conveyed in the front-back direction (see the arrow B in the figure). The tension applying unit 32 and the guide unit 33 prevent bend and slack from occurring in the print medium M when the print medium M is conveyed to the body 10.

The center axis X1 of the shaft 31 is orthogonal to the conveyance direction of the print medium M (left-right direction in the figure). The medium feeding unit 3 is located upstream of the body 10 in the conveyance direction.

The shaft 31 is rotated by a driving force of a stepping motor (not shown). A non-contact type sensor such as a known optical sensor, for example, can be used as the feeding speed detecting unit 35. The information detected by the feeding speed detecting unit 35 is sent to the controller 2 (see FIG. 2).

[Medium Winding Unit 4]

The print medium M after printing is held in a roll shape in the medium winding unit 4. The medium winding unit 4 includes a shaft 41 that passes through the roll-shaped print medium M (core member 40) in the direction of the center axis X2, a tension applying device 42 that applies tension (tensile force) to the print medium M, a guide device 43 that guides the print medium M from the body 10 to the shaft 41, and a winding speed detecting unit 45 that detects a rotation speed around the center axis X2 of the roll-shaped print medium M.

The center line of the shaft 41 is provided coaxially with the center axis X2 of the core member 40. Since known units can be used for the tension applying device 42 and the guide device 43, the description will be omitted.

The medium winding unit 4 sequentially winds (conveys) the portions conveyed from the body 10 while rotating the print medium M about the center axis X2 through the shaft 41. The print medium M is conveyed in the front-back direction (see the arrow C in the figure). The tension applying device 42 and the guide device 43 prevent bend and slack from occurring in the print medium M when the print medium M is wound by the shaft 41.

The center axis X2 of the shaft 41 is orthogonal to the conveyance direction of the print medium M (left-right direction in the figure). The medium winding unit 4 is located downstream of the body 10 in the conveyance direction.

The shaft 41 is rotated by a driving force of a stepping motor (not shown). A non-contact type sensor such as a known optical sensor, for example, can be used as the winding speed detecting unit 45. The information detected by the winding speed detecting unit 45 is sent to the controller 2 (see FIG. 2).

As shown in FIG. 1B, the body 10 includes an operation panel 21 of the controller 2. The operation panel 21 is provided with a liquid crystal display 22 for displaying various information and a ten key pad 23 for inputting various parameters and the like.

[Controller 2]

Figure 2:
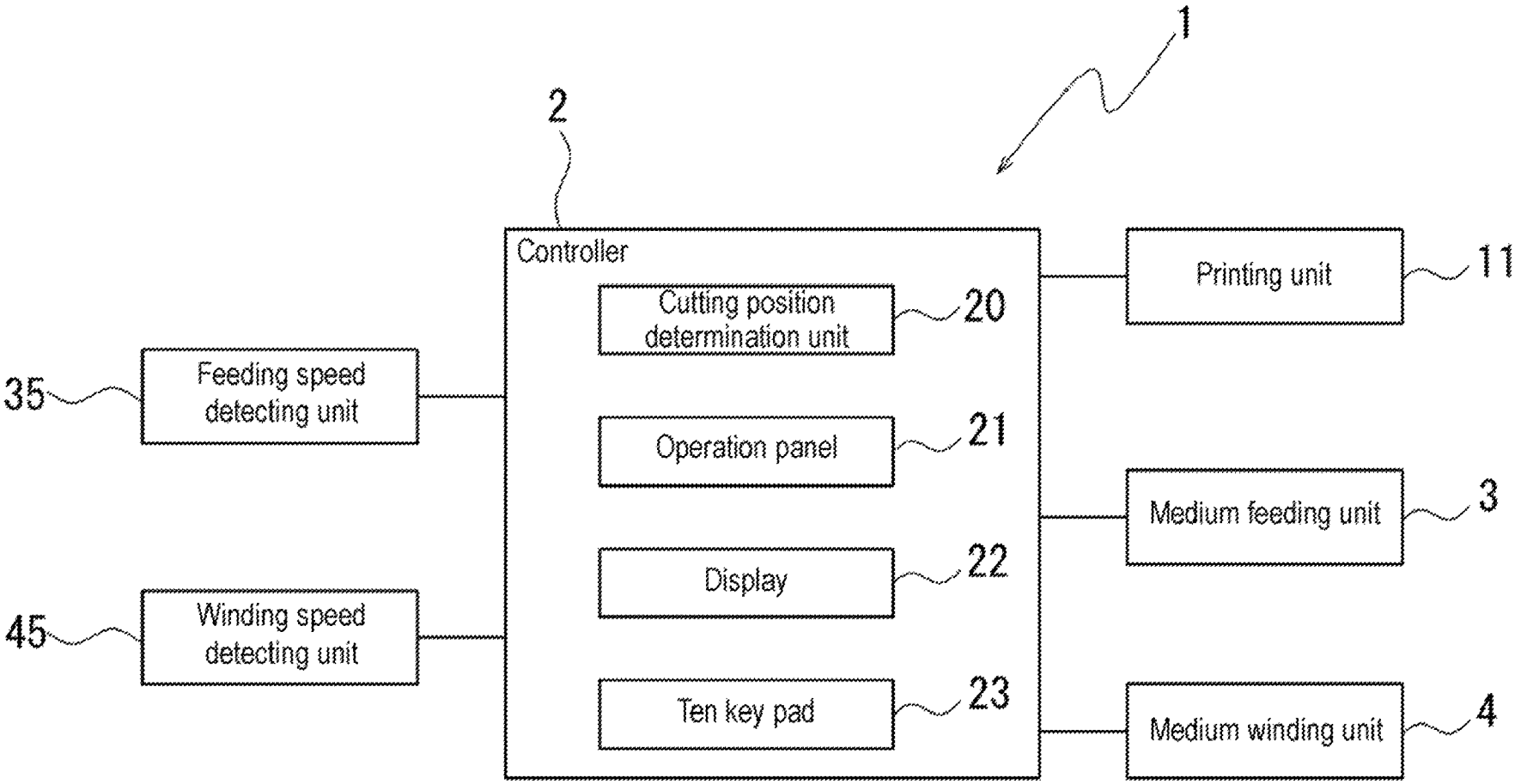
FIG. 2 is a block diagram describing a printer.

FIG. 2 is a block diagram describing the printer 1.

As shown in FIG. 2, the controller 2 includes the operation panel 21, a display 22, the ten key pad 23, and a cutting position determination unit 20, which will be described later. The cutting position determination unit 20 has a calculation function for calculating information input to the controller 2.

The controller 2 is electrically connected to the printing unit 11, the medium feeding unit 3, and the medium winding unit 4. The controller 2 controls the printing unit 11, the medium feeding unit 3, and the medium winding unit 4 based on the calculation result of the cutting position determination unit 20.

[Print Medium M]

Figure 3A:
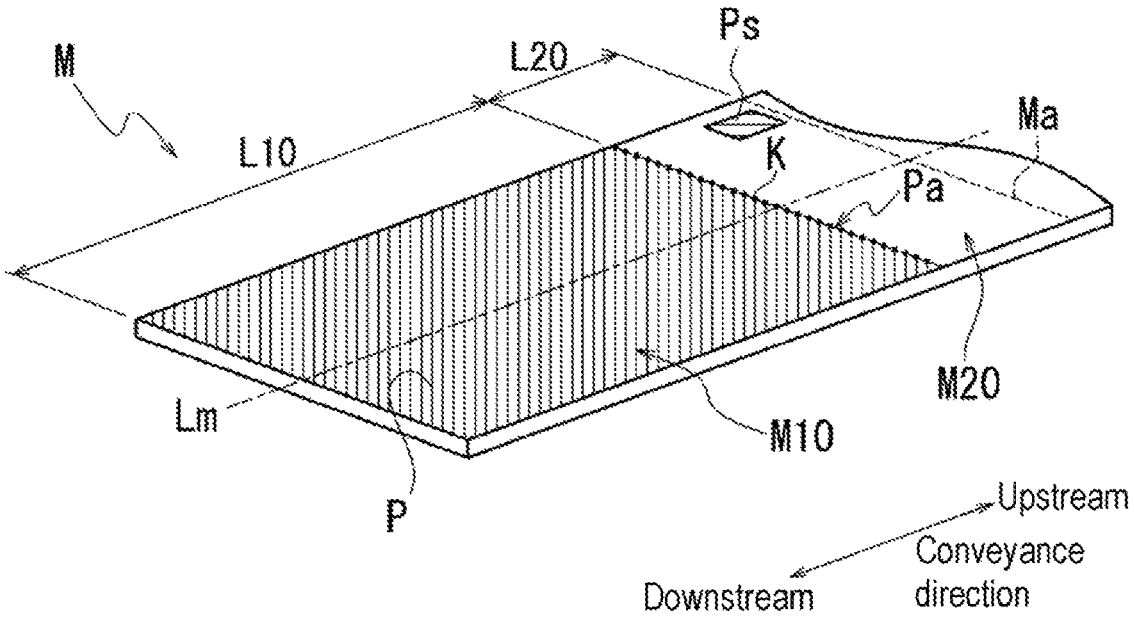
FIGS. 3A to 3C are views describing a print medium according to the present embodiment.
Figure 3B:
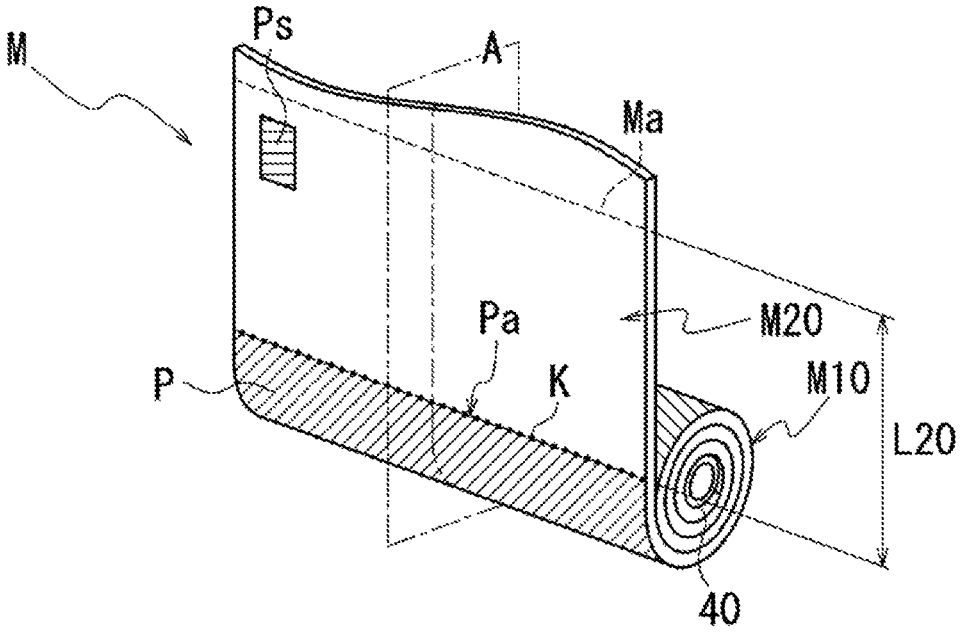
Figure 3C:
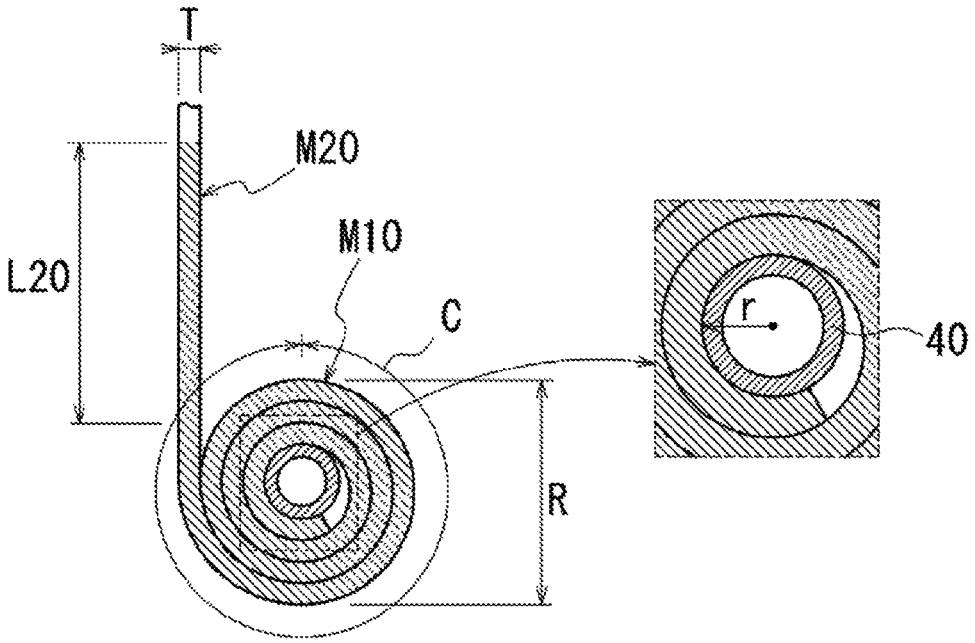

FIGS. 3A to 3C are views describing the print medium M according to the embodiment. FIG. 3A is a view showing a print medium M on which predetermined printing has been performed. FIG. 3B is a perspective view showing the print medium M wound around the core member 40, and shows a partially unfolded state. FIG. 3C is a schematic view of a cut surface obtained by cutting the print medium M of FIG. 3B along a plane A. In FIGS. 3A to 3C, the thickness of the print medium M is exaggerated. FIGS. 3A to 3C show a state of being wound with the print surface facing the outside.

Figure 4:
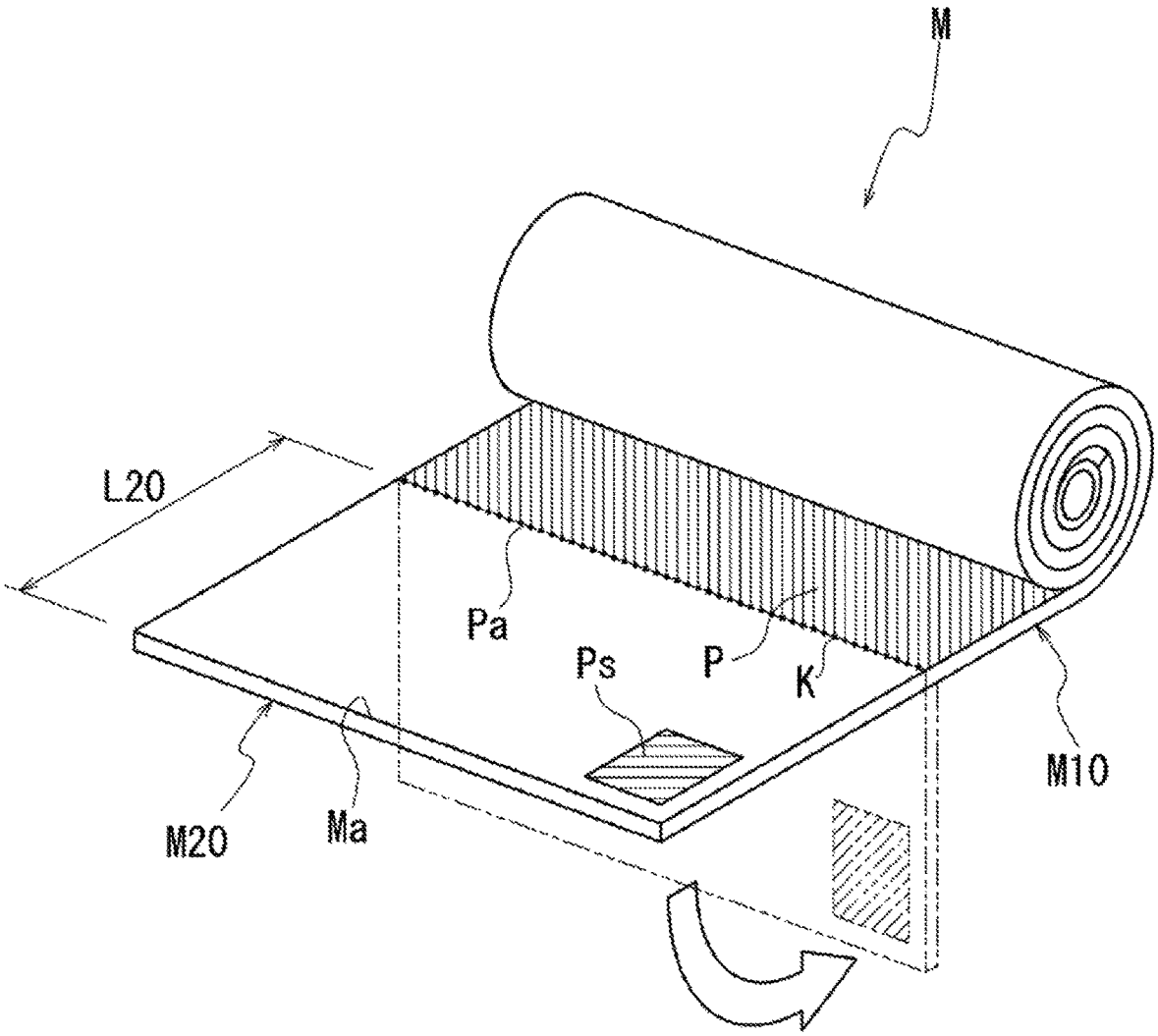
FIG. 4 is a view describing a print medium according to the present embodiment.

FIG. 4 is a view describing the print medium M according to the embodiment, and shows a state of being wound with the print surface of the print medium M on the inside after cutting at the cutting position Ma.

The print medium M is a single band-shaped sheet material (see FIG. 3A). The print medium M before printing is wound around the core member 30 in the direction of the straight line Lm along the longitudinal direction and stored in a roll shape. At the time of printing, the print medium M is set in the printer 1 in a state where the direction of the straight line Lm coincides with the conveyance direction (see FIG. 1A). The print medium M after printing is wound around the core member 40 in the direction of the straight line Lm and stored in a roll shape (see FIG. 3B).

The print medium M is conveyed from the medium feeding unit 3 to the medium winding unit 4 through the body 10 (printing unit 11) in the direction of the straight line Lm (see arrows B and C in FIG. 1A). In the printer 1, the printing is performed on the print surface of the print medium M by the printing unit 11 while the print medium M is conveyed by the medium feeding unit 3 and the medium winding unit 4. Therefore, the medium feeding unit 3 is located upstream of the printing unit 11 in the conveyance direction, and the medium winding unit 4 is located downstream of the printing unit 11 in the conveyance direction.

As shown in FIG. 3A, the print medium M has a first print surface M10 on which a predetermined image P (hatched portion in FIG. 3A) is printed, and a second print surface M20 on which a thumbnail image Ps of the image P (hatched portion in FIG. 3A) is printed.

Note that what is printed on the second print surface M20 is not limited to the thumbnail image Ps. For example, character information such as a serial number or a customer name may be printed.

In the present embodiment, a boundary line K that partitions the first print surface M10 and the second print surface M20 is printed on the print medium M (see a dotted line in FIG. 3A). The boundary line K is printed along an end Pa of an image P described later.

The first print surface M10 and the second print surface M20 are adjacent in the direction of the straight line Lm. The first print surface M10 and the second print surface M20 have lengths L10 and L20, respectively, in the direction of the straight line Lm.

The length L10 of the first print surface M10 is a length that substantially matches the length of the predetermined image P in the direction of the straight line Lm. The length L20 of the second print surface M20 is a length from an end Pa of the predetermined image P in the direction of the straight line Lm to a cutting position Ma (see a broken line in FIG. 3A) described later. The thumbnail image Ps is printed between the end Pa and the cutting position Ma.

In the present embodiment, when the print medium M is wound into a roll shape after printing is completed, the printing is performed first on the first print surface M10 side and then the printing is performed on the second print surface M20 side to position the second print surface M20 (thumbnail image Ps) at the outermost periphery. Therefore, in the conveyance direction of the print medium M, the first print surface M10 is on the downstream side, and the second print surface M20 is on the upstream side (see FIG. 3A).

Note that the thumbnail image Ps is preferably printed at a position on the second print surface M20 that is distant from the first print surface M10 in the direction of the straight line Lm. This is so that the thumbnail image Ps is reliably exposed on the front surface when the print medium M is wound.

The entire length of the print medium M with a sheet shape is longer than the total length (L10+L20) of the length L10 of the first print surface M10 in the direction of the straight line Lm and the length L20 of the second print surface M20. After the printing is completed, the parts forming the first print surface M10 and the second print surface M20 are cut and removed from the print medium M. The cutting is performed along a direction orthogonal to the straight line Lm (the width direction of the print medium M). In the present embodiment, the upstream side of the thumbnail image Ps (second print surface M20) in the conveyance direction is set at the cutting position Ma, and the print medium M is cut in the width direction at the cutting position Ma.

As described above, the thumbnail image Ps is printed on the second print surface M20. The size of the thumbnail image Ps is arbitrary. As long as the second print surface M20 is able to display the thumbnail image Ps, the length L20 of the second print surface M20 may be varied.

Therefore, the cutting position Ma in the present embodiment is determined by calculating the length L20 of the second print surface M20.

A method for calculating the length L20 of the second print surface M20 will be described.

The length L20 of the second print surface M20 is calculated according to the circumferential length C of the first print surface M10 in the form of a roll, to be described later.

As shown in FIG. 3C, the print medium M has a constant thickness T. Therefore, as the number of windings increases, the circumferential length of the print medium M wound into a roll shape becomes longer.

In the present embodiment, as the predetermined image P becomes larger, the length L10 of the first print surface M10 becomes longer. Then, the number of windings of the first print surface M10 increases, and hence the circumferential length C of the roll-shaped first print surface M10 also increases.

The second print surface M20 needs to cover the entire outer peripheral surface of the roll-shaped first print surface M10. To this end, it is necessary to ensure the length L20 of the second print surface M20 to be greater than or equal to the circumferential length C of the outermost periphery in the first print surface M10 (L20≥C).

In the printer 1 according to the present embodiment, the circumferential length C is calculated by the following two methods in order to calculate the length L20 of the second print surface M20. (i) A method of calculating the circumferential length C based on the rotation speed of the print medium M detected by the feeding speed detecting unit 35 of the medium feeding unit 3 and the winding speed detecting unit 45 of the medium winding unit 4. (ii) A method of calculating the circumferential length C from parameters by having the operator manually input predetermined parameters.

In the method (i), first, the cutting position determination unit 20 of the controller 2 calculates a diameter R of the first print surface M10 from the rotation speed of the print medium M detected by the feeding speed detecting unit 35 and the winding speed detecting unit 45. Next, the cutting position determination unit 20 calculates the circumferential length C based on the following equation (1).

$$C=\pi R \quad (1)$$

When the circumferential length C is calculated, the cutting position determination unit 20 calculates the length L20 of the second print surface M20 and determines the cutting position Ma so as to ensure a length greater than or equal to the circumferential length C. Based on this, the controller 2 controls the printing unit 11, the medium feeding unit 3, and the medium winding unit 4.

In the method (ii), the operator inputs predetermined parameters from the operation panel 21 (ten key pad 23) of the controller 2. The parameters are the thickness T and the material of the print medium M, the length L10 of the first print surface, and the bend radius r of the innermost side (core member 40 side) when the first print surface M10 is wound (see FIGS. 3A and 3C). These parameters may be those for directly inputting numerical values, or those for selecting parameters registered in advance as data. The length L10 of the first print surface may be automatically calculated from the data of the image P.

The cutting position determination unit 20 calculates the diameter R of the first print surface M10 from the input (selected) parameters based on the following equations (3) and (4). Next, the cutting position determination unit 20 calculates the circumferential length C based on the following equation (2).

$$C=\pi R \quad (2)$$

$$R=2(r+nT) \quad (3)$$

$$L10=2\pi rn+\pi Tn(n+1) \quad (4)$$

When the circumferential length C is calculated, the cutting position determination unit 20 calculates the length L20 of the second print surface M20 and determines the cutting position Ma so as to ensure a length greater than or equal to the circumferential length C. Based on this, the controller 2 controls the printing unit 11, the medium feeding unit 3, and the medium winding unit 4.

Here, the winding mode of the print medium M by the medium winding unit 4 includes the following two modes depending on the rotating direction of the shaft 41. (A) A mode in which the shaft 41 rotates counterclockwise (direction of arrow D in FIG. 1A) when viewed from the direction of the center axis X2.

In this mode, the print medium M is wound around the core member 40 with the print surfaces (the first print surface M10 and the second print surface M20) on the outside (see the solid line in FIG. 1A). (B) A mode in which the shaft 41 rotates clockwise (direction of broken line arrow E in FIG. 1A) when viewed from the direction of the center axis X2.

In this mode, the print medium M is wound around the core member 40 with the print surfaces (the first print surface M10 and the second print surface M20) on the inside (see the broken line in FIG. 1A).

In the case of (A), the second print surface M20 (thumbnail image Ps) is exposed to the outside at the outermost peripheral surface of the roll-shaped print medium M. Therefore, it is possible to easily check the management and the contents of the printed print medium M while the medium is being wound by the medium winding unit 4.

In the case of (B), the surface (back surface) on the side opposite to the print surface of the print medium M is exposed to the front surface. Therefore, in the state where the medium is wound by the medium winding unit 4, the thumbnail image Ps is hidden, and the management and the contents of the printed print medium M cannot be performed.

The boundary line K is printed on the print medium M. It is possible to easily check the management and the contents of the printed print medium M by turning back the second print surface M20 side of the print medium M to the outside at the boundary line K (in the direction of the arrow in FIG. 4) and exposing the thumbnail image Ps on the front surface.

In either of the cases (A) and (B), the second print surface M20 covers the outer periphery of the first print surface M10 over the entire periphery. Therefore, the image P is appropriately protected.

The printer 1 according to the present embodiment has the following configuration.

(1) A printing unit 11 that performs printing on a print medium M with a sheet shape, a medium feeding unit 3 and a medium winding unit 4 (medium conveying unit) that conveys the print medium M in a predetermined conveyance direction, a controller 2 (control unit) that controls the printing unit 11, the medium feeding unit 3, and the medium winding unit 4, and a shaft 41 (winding roller) that winds the printed print medium M are provided. The controller 2 includes a cutting position determination unit 20 that determines a cutting position Ma (determines the length L20 of the second print surface M20) to cut and separate the print medium M in the width direction upstream by a predetermined length from the end Pa of the image P of the first print surface M10 (part on which the predetermined printing has been performed) in the conveyance direction.

The cutting position determination unit 20 determines the cutting position Ma so as to cut upstream from the end Pa with an increase in the circumferential length C of the print medium M wound around the shaft 41.

With this configuration, the cutting position Ma can be determined (customized) according to the size of the image P. This makes it possible to cover the first print surface M10 (image P) or print the management information using the second print surface M20 (the region from the end Pa of the image P to the cutting position Ma). Therefore, the printed print medium M (printed matter) can be stored so that the management and the contents can be checked while appropriately protecting the image P.

The printer 1 according to the present embodiment has the following configuration.

(2) The printing unit 11 prints the thumbnail image Ps (management information) on the second print surface M20 (region on which the predetermined printing has not been performed) between the end Pa and the cutting position Ma.

With this configuration, the contents of the printed print medium M can be checked and managed from the thumbnail images Ps without unwinding the rolled state.

The printer 1 according to the present embodiment has the following configuration.

(3) The region between the end Pa forming the second print surface M20 and the cutting position Ma is wound to protect the first print surface M10 on which the image P is printed (the medium of the part on which the predetermined printing has been performed) and is wound to expose the printed thumbnail image Ps on the front surface.

With this configuration, the print medium can be stored so that the management and the contents of the printed print medium M can be checked while appropriately protecting the image P.

(4) The cutting position determination unit 20 determines the cutting position Ma such that the circumferential length C is at least one round of the outer periphery of the print medium M wound around the shaft 41.

With this configuration, the second print surface M20 covers the entire outer peripheral surface of the first print surface M10, and hence the image P is reliably protected.

The printer 1 according to the present embodiment has the following configuration.

(5) The cutting position determination unit 20 calculates the circumferential length C of the first print surface M10 based on equations (1), (2) and (3) and calculates the entire length L20 of the second print surface M20, where R is the winding diameter of the first print surface M10, L10 is the entire length of the first print surface, r is the innermost bend radius when the first print surface M10 is wound, T is the thickness of the print medium M, and 7E is the Pi.

$$C=\pi R \tag{1}$$

$$R=2(r+nT) \tag{2}$$

$$L10=2\pi rn+\pi Tn(n+1) \tag{3}$$

With this configuration, the operator can manually input parameters to the controller 2 to calculate the entire length L20 of the second print surface M20 and determine the cutting position Ma.

The printer 1 according to the present embodiment has the following configuration.

(6) The medium feeding unit 3 is provided upstream of the printing unit 11 in the conveyance direction of the print medium M. The medium feeding unit 3 includes a feeding speed detecting unit 35 that detects a feeding speed of the print medium M.

The medium winding unit 4 is provided downstream of the printing unit 11 in the conveyance direction of the print medium M. The medium winding unit 4 includes a winding speed detecting unit 45 that detects a winding speed of the print medium M.

The cutting position determination unit 20 calculates, based on the detection results of the feeding speed detecting unit 35 and the winding speed detecting unit 45, the circumferential length C of the first print surface M10 that has been wound into a cylindrical shape to calculate the entire length L20 of the second print surface M20.

The controller 2 controls the printing unit 11, the medium feeding unit 3, and the medium winding unit 4 based on the calculation result of the cutting position determination unit 20.

With this configuration, it is possible to automatically calculate the entire length L20 of the second print surface M20 and determine the cutting position Ma.

The printer 1 according to the present embodiment has the following configuration. (7) The thumbnail image Ps is printed at a position in the second print surface M20 away from the first print surface M10 (on the cutting position Ma side).

For example, when the length L20 of the second print surface M20 is twice as long as the circumferential length C, the second print surface M20 makes substantially two rounds around the first print surface M10. Then, when the thumbnail image Ps is printed in the vicinity of the boundary line K, the thumbnail image Ps is located on the inside by one round and thus is not exposed on the front surface.

Therefore, with the above configuration, the thumbnail image Ps can be reliably exposed on the front surface.

The printer 1 according to the present embodiment has the following configuration. (8) The printing unit 11 prints a boundary line K with the second print surface M20 on the end Pa.

With this configuration, the print medium M wound with the print surface on the inside becomes a mark when turning back the second print surface M20 side to the outside.

Furthermore, the present disclosure can also be specified as a control method of the printer 1.

In particular, (9) A printing device that performs printing by ejecting ink on a print medium M having a sheet shape with the printing unit 11, a medium conveying device that conveys the print medium M in a predetermined conveyance direction with the medium feeding unit 3 and the medium winding unit 4, and a control device that controls the printing device and the medium conveying device with the controller 2 are provided.

The control device includes a cutting position determination device that determines a cutting position Ma for cutting upstream by a predetermined length from the end Pa of the image P on the first print surface M10 in the conveyance direction.

The cutting position determination device determines the cutting position Ma so as to cut more upstream from the end Pa with increase in the length L10 of the first print surface M10.

The printing device prints the thumbnail image Ps on the second print surface M20.

The second print surface M20 is wound so as to protect the first print surface M10, and is wound so that the printed thumbnail image Ps is exposed on the front surface.

The cutting position determination device calculates the entire length L20 of the second print surface M20 so as to surround the outer periphery of the first print surface M10 over the entire periphery in a state in which the print medium M is wound from the downstream side to the upstream side in the conveyance direction.

With this configuration, control can be performed such that the second print surface M10 on which the thumbnail image Ps is printed is exposed on the front surface.

Furthermore, the control method of the printer 1 has the following configuration.

(10) A medium feeding device provided upstream of the printing unit 11 in the conveyance direction to feed the print medium M with the medium feeding unit 3, and a medium winding device provided downstream of the printing unit 11 in the conveyance direction to wind the print medium M with the medium winding unit 4 are provided.

In the medium feeding device, the feeding speed of the print medium M is detected by the feeding speed detecting unit 35.

In the medium winding device, the winding speed of the print medium M is detected by the winding speed detecting unit 45.

The cutting position determination device calculates, based on the detection results of the feeding speed detecting unit 35 and the winding speed detecting unit 45, the circumferential length C of the first print surface M10 that has been wound into a cylindrical shape to calculate the entire length L20 of the second print surface M20.

The control device controls the printing device, the medium feeding device, and the medium winding device based on the calculation result of the cutting position determination device.

With this configuration, the entire length L20 of the second print surface M20 can be automatically determined.

[Modified Example]

In the present embodiment, the boundary line K is represented by printing, but this is not the sole case. For example, the printer 1A may include a medium processing unit (not shown). The medium processing unit may form intermittent cuts (e.g., perforations) in the print medium M instead of performing printing of the boundary line K or by overlapping the printing of the boundary line K.

Thus, the second print surface M20 can be separated from the first print surface M10 after printing is completed. For example, on the print medium M that has been wound with the print surface facing inside, the second print surface M20 is separated and the outer periphery of the first print surface M10 is covered, so that the thumbnail image Ps is exposed on the front surface and management and contents of the printed print medium M can be easily checked.

The printer 1A according to the modified example has the following configuration.

(11) A medium processing unit that forms intermittent cuts along the end Pa is provided.

With this configuration, the second print surface M20 can be separated from the first print surface M10 after printing is completed.

In the present embodiment, as the parameters for calculating the circumferential length C of the wound first print surface M10, the thickness T of the print medium M, the winding diameter R of the first print surface M10, and the like have been described, but these are not the only cases. For example, the weight, print time, print data, and the like of the print medium M may be used as parameters.

Furthermore, the method of obtaining the winding amount of the print medium M according to the present embodiment by detecting the rotation speed of the print medium M by the feeding speed detecting unit 35 and the winding speed detecting unit 45 has been exemplified. However, this is not the sole case. For example, the winding amount may be obtained by detecting the outer diameter of the wound print medium M. A non-contact type sensor such as a known optical sensor, for example, can be used to detect the outer diameter of the print medium M.

Furthermore, the printer 1 may be capable of performing double-sided printing, and may have a second print surface M20 provided on the back surface of the first print surface M10. In this case, the second print surface M20 is exposed to the outside by winding with the first print surface M10 side on the inside, so that turning-back is unnecessary.

When manually winding and storing the printed print medium M, the second print surface M20 may be provided upstream of the first print surface M10.

Moreover, the second print surface M20 may be provided on both upstream and downstream of the first print surface M10. There is an advantage in that the second print surface M20 can be exposed to the outer peripheral surface regardless of whether it is wound from either the upstream side or the downstream side.

What is claimed is:

1. A printing apparatus comprising:

a printing unit, configured to performs printing on a medium with a sheet shape;

a medium conveying unit, configured to convey the medium in a conveyance direction that is predetermined;

a control unit, configured to control the printing unit and the medium conveying unit; and a winding roller, configured to wind the medium that is printed, wherein the control unit includes a cutting position determination unit configured to determine a cutting position to cut and separate the medium in a width direction upstream by a predetermined length from an end of a part on which a predetermined printing has been performed in the conveyance direction; and the medium is wound into a roll shape by the winding roller, and the predetermined printing is applied to an outside surface of the roll shape; and the cutting position determination unit is configured to:

determine the cutting position, so as to cut upstream from the end with an increase in a circumferential length of the medium wound into the roll shape, and dispose a blank region where the predetermined printing is not performed between the end and the cutting position, so as to cover an entire outer peripheral surface of the medium of the part on which the predetermined printing has been performed.

2. The printing apparatus according to claim 1, wherein the printing unit is configured to print a management information in the blank region, and the control unit is configured to wind the medium, so as to expose the management information.

3. The printing apparatus according to claim 2, wherein the cutting position determination unit is configured to determine the cutting position, so that a length of the medium is at least one round of an outer periphery of the medium wound around the winding roller.

4. The printing apparatus according to claim 2, wherein the printing unit is configured to perform printing by an inkjet method.

5. The printing apparatus according to claim 1, wherein the cutting position determination unit is configured to determine the cutting position, so that a length of the medium is at least one round of an outer periphery of the medium wound around the winding roller.

6. The printing apparatus according to claim 1, wherein the printing unit is configured to perform printing by an inkjet method.

* * * * *